United States Patent [19]

Cann et al.

[11] 4,202,409

[45] May 13, 1980

[54] ONE PIECE TOP COVER WITH STAMPED OPEN LOUVERS AND MOTOR MOUNT

[75] Inventors: Peter L. Cann, Canastota; Richmond S. Hayes, Jr., Fayetteville; Lester N. Miller, Syracuse, all of N.Y.

[73] Assignee: Carrier Corporation, Syracuse, N.Y.

[21] Appl. No.: 889,582

[22] Filed: Mar. 23, 1978

[51] Int. Cl.[2] ..... F24H 13/14

[52] U.S. Cl. ..... 165/122; 165/125

[58] Field of Search ..... 165/98, 99, 122, 125, 165/126, 141; 62/506, 507, 508, 428, 455, 450, 181; 98/40 V, 40 VM, 101, 111; 29/157.3 A

[56] References Cited

U.S. PATENT DOCUMENTS

| | | | |
|---|---|---|---|
| 1,872,785 | 8/1932 | Modine | 165/122 |
| 2,174,654 | 10/1939 | Fink | 165/99 |
| 2,185,484 | 2/1940 | Welch et al. | 29/157.3 A |
| 2,584,982 | 2/1952 | Burke | 165/98 |
| 3,865,517 | 2/1975 | Simmons et al. | 62/507 |

*Primary Examiner*—Carroll B. Dority, Jr.
*Assistant Examiner*—Theophil W. Streule, Jr.
*Attorney, Agent, or Firm*—J. Raymond Curtin; Robert P. Hayter

[57] ABSTRACT

A heat exchange unit for use in an air conditioning system having an enclosure defining an opening, a heat exchanger within the enclosure and a cover adapted and mounted to the enclosure at the opening, the cover having segments extending between the center portion of the cover and the end surface such that slots are created between adjacent segments. The segments have inclined louver sections such that the air flow through the grille is optimized with the particular fan characteristics. The fan and fan motor may be secured to the center portion of the cover.

13 Claims, 6 Drawing Figures

ONE PIECE TOP COVER WITH STAMPED OPEN LOUVERS AND MOTOR MOUNT

BACKGROUND OF THE INVENTION

1. Field of the Invention

This invention relates to heat exchange units for use in an air conditioning system. Particularly this invention relates to a combination cover and grille for use with the outdoor heat exchange unit of a heat pump or the condenser unit of a cooling system or a packaged system.

2. Description of the Prior Art

Air conditioning systems for conditioning residences and other interior spaces frequently utilize a combination of components such that the condenser unit of an air conditioning system is located outside of the residence and the evaporator unit of the system is located in communication with the interior space to be cooled. In a heat pump application the system might have an outdoor heat exchange unit located without the enclosure and an interior heat exchange unit in communication with the interior space to be conditioned. These systems further utilize a compressor and appropriate expansion valves and piping such that heat may be transferred either to the region to be heated or from the region to be cooled. Each outdoor unit has an electric motor and fan associated therewith such that outdoor air may be drawn through the heat exchanger of the unit. This air typically flows through a grille either entering the unit or being discharged from the unit.

The proper mounting and operation of the unit is very important because of the operation of the air conditioning system depends upon the capability of the heat exchanger located in the outdoor unit to transfer heat to or from the air. Furthermore, the outdoor location of the fan and motor renders it susceptible to various sorts of damage. For example, the operation of the fan motor can be seriously impaired if moisture or dirt enter the motor bearings. The likelihood of such damage is greater in those units wherein the fan shaft extends vertically upwardly since water can run down the shaft and through the bearings. Another type of problem to which these outdoor units are susceptible is movement of the fan assembly relative to the air discharge opening in the enclosure. The fan assembly has heretofore been attached either directly to the enclosure or to legs fastened to the enclosure walls. These supports for the fan assembly can be distorted during shipment of the unit to the installation site or after the unit has been installed in its outdoor location. Movement of the fan assembly relative to the discharge opening housing changes the path of flow through the opening, generally resulting in reduction of the air flow rate. In addition, the incorporation of the foregoing types of motor mounts requires an expense whose removal or reduction would be advantageous.

Typical of the previous motor mounting systems utilizing a grille is U.S. Pat. No. 3,865,517 assigned to the assignee herein. Therein a grille is formed from a series of circular shaped members to prevent objects from entering the heat exchange assembly while maintaining sufficient openings to allow for the movement of air therethru. Other patents involving grille assemblies and motor mounting means include Trask (U.S. Pat. No. 2,920,464), Day (U.S. Pat. No. 3,115,757) and Fowell et al (U.S. Pat. No. 3,714,795). All of these patents relate to means for mounting motors in reference to the fan and grille for air discharge.

The present invention relates to a unitary single piece. The top cover with stamped radial open louvers simultaneously serves as a grille and motor mount. The louvers are inclined sections of adjacent radially extending segments. The degree of inclination of the louvers is matched with the inclination characteristics of the fan blade such that these louvers act to optimize the air flow of the fan for a certain amount of energy input into the motor. None of the above referenced patents discloses using a unitary stamped air grille cover nor do they disclose using the design of the grille to optimize the air flow characteristics of the fan. Furthermore the center portion of the grille serves to protect the fan motor and bearings from the elements eliminating the need for a rain shield or other protective covering for the motor.

SUMMARY OF THE INVENTION

An object of the present invention is to provide a cover for an outdoor heat exchange unit.

A further object of the invention is to mount an electric motor and fan to a cover such that the air flow through the unit is discharged or drawn in through the cover itself such that the louvers act as pre-whirl or pre-rotation vanes.

A further object of the present invention is to provide aerodynamic louvers such that the energy consumption to the motor for moving a given quantity of air is minimized.

A further object of the present invention is to mount a fan assembly in an outdoor heat exchanger in a manner which is economical and which improves the functioning of the fan.

Another object of the present invention is to mount a fan assembly in an outdoor heat exchanger unit in a manner which protects the fan shaft and motor against damage from moisture and dirt.

Yet another object of the present invention is to provide an air discharge grille incorporated within the cover such that slots sufficient to allow discharge of the air but of such a size to prevent large foreign articles including human appendages from being inserted therein encloses the opening of the unit.

Other objects will be apparent from the description to follow and from the appended claims.

The foregoing objects are achieved according to a first embodiment of the invention by providing an outdoor heat exchange unit having an enclosure defining an opening, a heat exchanger within the enclosure and a cover adapted to be mounted to the opening. The cover has segments extending between the center portion and the end surface of the cover such that slots are created between adjacent segments, the segments having an inclined louver section. A fan and motor are mounted to the center of the cover such that upon energization air is circulated through the heat exchanger and through the slots of the cover. The inclined louver sections of the segments are inclined at such an angle to optimize the air flow for a given energy requirement of the fan motor. A center section is provided in the cover such that the vertically extending motor shaft is protected from dirt and moisture. In a second embodiment of the invention the segments have a flat section and a louver section.

DESCRIPTION OF THE PREFERRED EMBODIMENTS

The embodiments of the invention described below comprise an outdoor heat exchanger unit which includes an enclosure for a heat exchanger, an opening to which the cover is mounted, a fan motor and a fan mounted thereto. The particular apparatus as described will be that of the outdoor heat exchanger unit of a heat pump. It is to be understood that this invention is applicable to any heat exchange unit utilizing a fan to move air in heat exchange relation with a heat exchanger. This device will further find like applicability to similar applications such as humidifiers or fans. Furthermore these embodiments will be described utilizing a cylindrical enclosure however this invention is equally applicable to square, rectangular or other configured covers. Also the segments herein will be referred to as radially extending but it is to be understood that they may be skewed from radial, alternated or any other way joined from the center portion of the cover to the end surface thereof.

Figure 1:
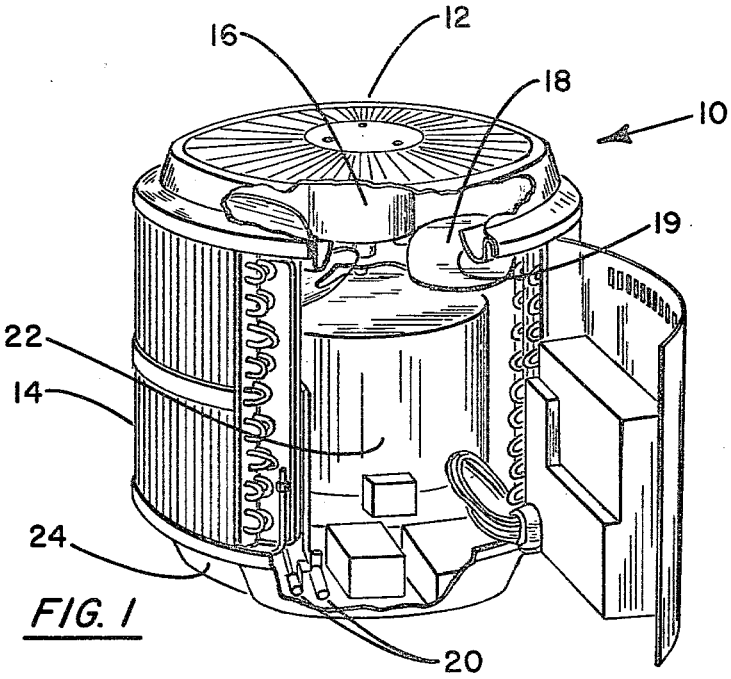
FIG. 1 is a perspective view of an outdoor heat exchange unit.

Referring now to the drawings it can be seen in FIG. 1 that heat exchange unit 10 has heat exchanger 14 mounted to base 24. Heat exchange unit 10 is adapted to be an outdoor heat exchanger of a refrigeration system typically a heat pump. Cover 12 is mounted to heat exchanger 14 with motor 16 being suspended from the center portion of cover 12 and fan 18 being located on the shaft of the motor. Compressor 22 is shown within the unit as are refrigerant connections 20 and various other internal components such as a reversing valve, a capacitor, controls, an expansion valve and the other various components of the system. Fan orifice 19 for acting as an air flow guide for the fan is also shown.

Figure 2:
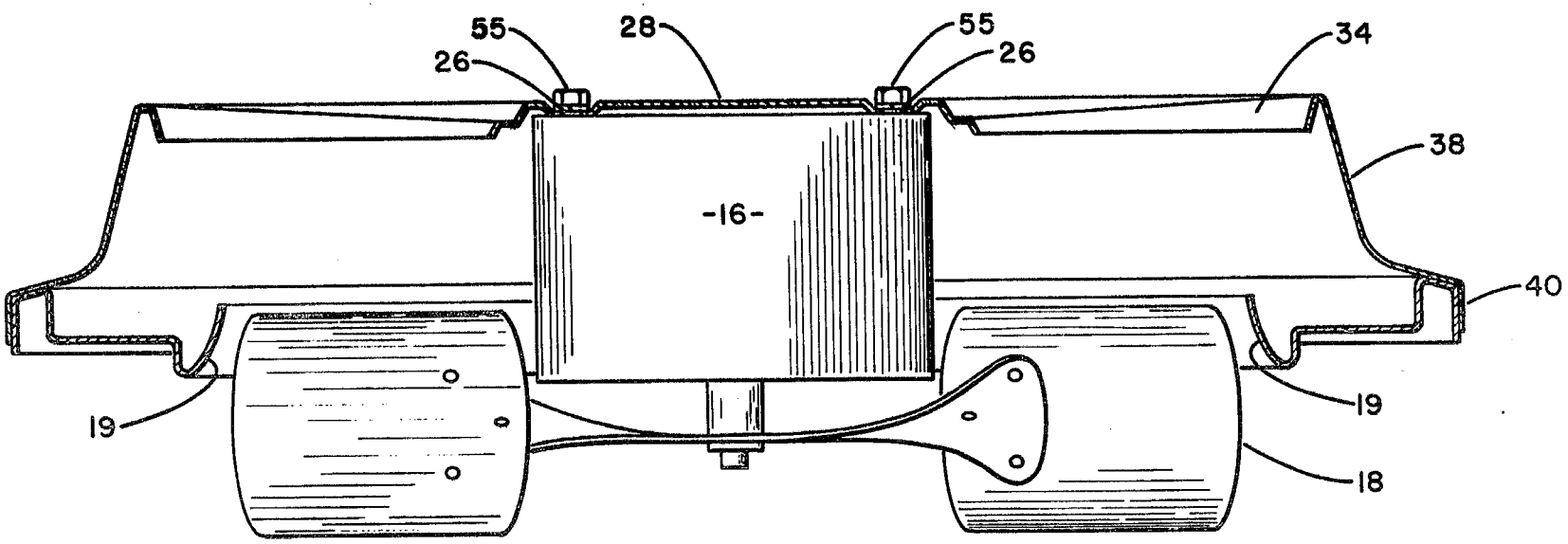
FIG. 2 is a cutaway sectional view of the fan motor and fan mounted to the cover herein.

In FIG. 2 it can be seen that cover 12 has been formed in a generally cylindrical shape having a smooth upper surface and generally cylindrical end surfaces 38 and lip 40. Lip surface 40 is designed to be secured upon heat exchanger 14 of the unit thru fan orifice 19. Fan motor 16 is shown secured through motor mount holes 26 by bolts 55 to cover 12. Suspended from the motor 16 is fan 18 shown as a propeller type fan having inclined blades. Fan 18 is sized to cooperate with fan orifice 19 for moving air thru the cover.

Figure 3:
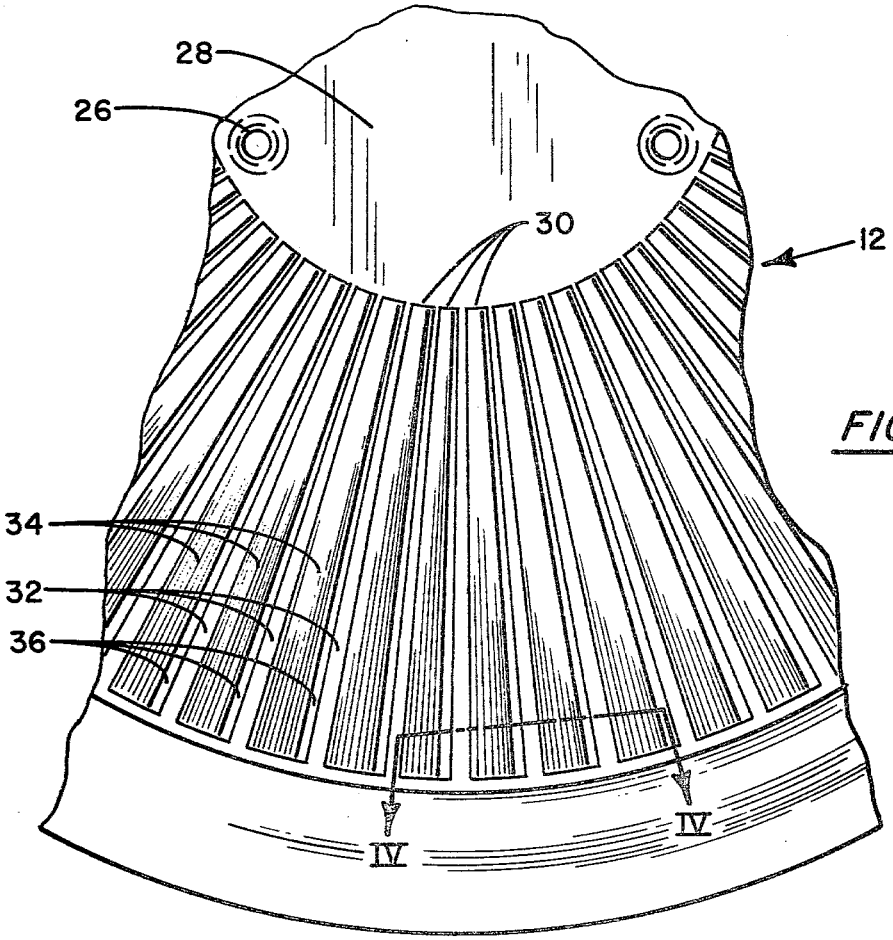
FIG. 3 is an enlarged fragmentary top view showing the segments of the cover having flat sections and louver sections.

It can be seen in FIG. 3, a cutaway top elevation view of cover 12, that the center portion 28 of the cover is smooth and uninterrupted except for motor mount holes 26. Extending radially outward from the center portion of the cover are segments 30 of generally increasing widths from the center of the cover radially outward. The segments 30 are made up of flat sections 32 and louver sections 34. Between adjacent segments 30 are openings for the flow of air designated as slots 36. These openings are also generally increasing in width from the center of the cover radially outward.

Figure 4:
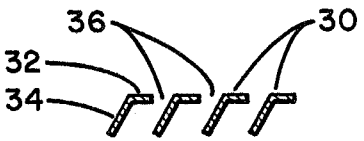
FIG. 4 is a cross sectional view of segments 30 taken along line IV—IV in FIG. 3.

FIG. 4 more particularly shows flat section 32 and louver section 34 of each radially extending segment 30. Slot 36 is the area between adjacent segments 30. The louver section 34 is angled so as to optimize the air flow characteristics with the particular fan being used such that the amount of energy necessary for the motor to drive the fan for a given air flow is minimized.

It can be further seen in FIG. 2 that the depth of louver section 34 increases from the center of the cover radially outward toward the outer edges of the cover. This increase in depth is also indicative of the increase in width of slots 36 between adjacent segments. The louver section 34 and flat section 32 are all formed when a single flat sheet is stamped to the appropriate configuration. The metal that was in the area of the designated slot 36 has been downwardly deformed to form louver section 34. Consequently, from a single flat piece of metal a cover is formed with radially extending segments 30 having flat sections 32 and louver sections 34 and defining therebetween slot 36 for the discharge of air. The inclined angle that louver section 34 makes with flat section 32 is significant together with the size of the flat section 32 to create sufficient static regain that the air flow characteristics of the fan are maximized. The various segments act as stators to add to the overall fan efficiency of the unit.

Figure 5:
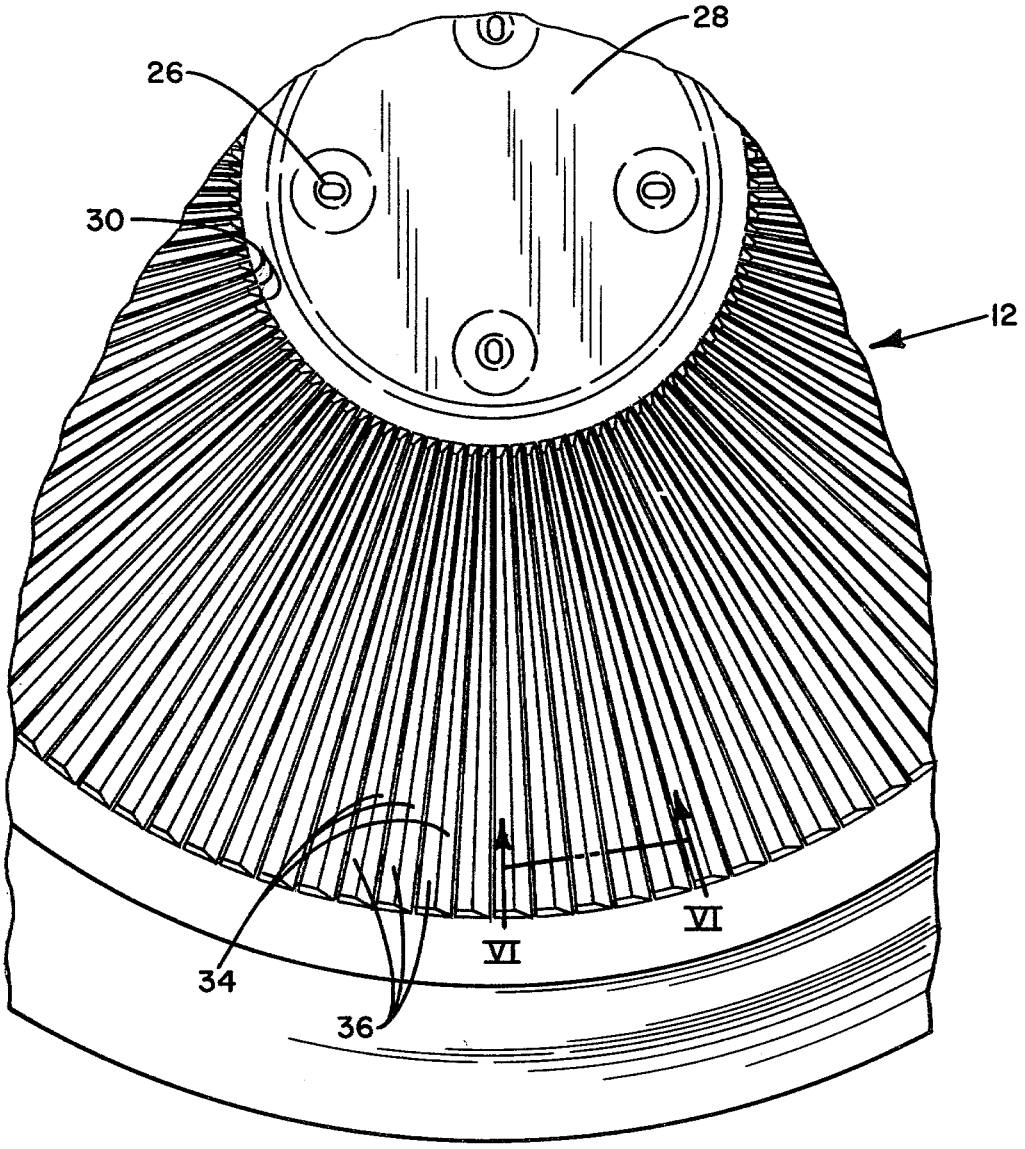
FIG. 5 is an enlarged fragmentary top view showing the segments of the cover having only louver sections.
Figure 6:
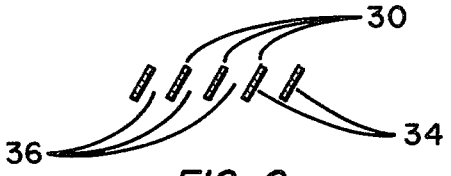
FIG. 6 is a cross sectional view of segments 30 taken along line VI—VI in FIG. 5.

In FIGS. 5 and 6 another embodiment of this invention is shown. Therein the segments 30 comprise louver sections 34. The entire segment is angled such that there is no flat section. In FIG. 6, a cross-sectional view of these segments, the relation between the louver sections 34 and the slots 36 may more particularly be seen. The remaining reference numerals on FIGS. 5 and 6 correspond to the same numerals as are in FIGS. 3 and 4.

By securing fan 18 and fan motor 16 from the center portion of the cover 28 a flat and continuous surface is provided over the vertically extending shaft axis of the fan and motor. Consequently dirt, moisture and other unwanted contaminants may not directly enter the fan shaft or bearings from above. Furthermore the slots 36 are so designed that the maximum size thereof is such that even a child should not be able to insert his hands or other bodily members to such an extent that impact with the fan would be possible.

The invention has been described in detail with particular reference to preferred embodiment thereof, but it will be understood that variations and modifications can be affected within the spirit and scope of the invention.

We claim:

1. A heat exchange assembly for use with an air conditioning system which comprises a heat exchange unit defining an opening for the passage of heat transfer media a heat exchanger mounted within the unit in heat exchange relation with the heat transfer media a cover adapted to overlay at least a portion of the opening, the cover having an end portion extending about the periphery thereof and a solid center portion, said cover further comprises generally radially extending fixed segments located intermediate said end portion and said center portion and connecting said end portion to said center portion, at least some of said segments having a louver section formed by displacing a portion of the segment from the plane of the segments, said louver section defining a slot with adjacent segments for the passage of heat transfer media therethrough: and means juxtaposed to the cover for circulating the heat transfer media through the slots in the cover.

2. The apparatus as set forth in claim 1 wherein the fan means is a propeller type fan rotated by a motor and wherein the inclined louver sections of the cover segments are angled in conjunction with the configuration of the fan to optimize gas flow per unit of energy supplied to the fan motor.

3. The invention set forth in claim 2 wherein the fan and motor are supported by the cover.

4. The invention set forth in claim 1 wherein the cover is formed from a unitary piece of material.

5. The apparatus as set forth in claim 4 wherein the slots between adjacent segments of the cover are formed by the louver section of the segment being bent at an angle to the plane of the top of the cover.

6. The apparatus as set forth in claim 1 wherein the segments have a flat section and a louver section angled therefrom.

7. The apparatus as set forth in claim 1 wherein the cover is cylindrical in configuration and wherein the center of the cover is flat with the segments extending radially outward from the center section.

8. The apparatus as set forth in claim 3 wherein the fan means incudes a motor having bolts extending therefrom which may be used to secure the fan and motor to the center portion of the cover.

9. A cover adapted to form a portion of the outer surface of a heat exchange device through which gas is circulated which comprises:

an end portion extending about the periphery of the device for supporting the cover;

a center portion located intermediate the end portion; and a plurality of generally radially extending segments structurally connecting the center portion to the end portion, at least some of said segments having a louver section formed therefrom by displacing a portion of the segment at an angle therefrom, said louver section and the adjacent segment defining a slot for the passage of the circulated gas.

10. The apparatus as set forth in claim 9 wherein the segments comprise a flat section and an inclined louver section.

11. The invention as set forth in claim 9 wherein the louver sections are inclined at an angle to optimize air flow per unit of energy supplied to the fan motor.

12. The apparatus as set forth in claim 9 wherein the cover is formed from a unitary piece of material such that the slots between adjacent segments are formed by the louver section of the segment being bent at an angle to the plane of the top of the cover.

13. The apparatus as set forth in claim 9 wherein the cover is cylindrical in configuration and wherein the center of the cover supports the fan and motor and wherein segments extend radially outward from the center.

* * * * *